US007451977B2

(12) United States Patent
Gabel et al.

(10) Patent No.: US 7,451,977 B2
(45) Date of Patent: Nov. 18, 2008

(54) DOCUMENT STACKER APPARATUS AND METHOD OF STACKING DOCUMENTS

(75) Inventors: Tammer A. Gabel, Waterloo (CA); Fredrik L. N. Kallin, Waterloo (CA); Frank B. Dunn, Waterloo (CA); David W. Norris, Cambridge (CA); Anthony R. Dunn, Whittlesford (GB); William J. Cramer, Cambridge (GB); Steven A. Hunt, Cambridge (GB); Gary S. Howard, Swavesey (GB)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 11/788,087

(22) Filed: Apr. 19, 2007

(65) Prior Publication Data

US 2007/0194518 A1 Aug. 23, 2007

Related U.S. Application Data

(63) Continuation of application No. 11/016,789, filed on Dec. 20, 2004, now Pat. No. 7,229,071.

(51) Int. Cl.
*B65H 29/44* (2006.01)

(52) U.S. Cl. ..... 271/180; 271/177; 109/22; 109/47

(58) Field of Classification Search ..... 271/176–177, 271/180–181, 188, 189, 220
See application file for complete search history.

(56) References Cited

U.S. PATENT DOCUMENTS 3,655,186 A * 4/1972 Bayha ..... 271/180
4,790,476 A 12/1988 Tanaka et al.
5,286,017 A * 2/1994 Hawk et al. ..... 271/303
5,470,050 A 11/1995 Anma
6,966,555 B2 11/2005 Cost et al.
7,059,599 B2 6/2006 Lewis
2003/0226890 A1 12/2003 Elwin

FOREIGN PATENT DOCUMENTS

JP 01060557 A 3/1989
JP 06156844 A 6/1994

* cited by examiner

*Primary Examiner*—Patrick H Mackey
*Assistant Examiner*—Jeremy Severson
(74) *Attorney, Agent, or Firm*—Michael Chan

(57) ABSTRACT

A plunger moves from a retracted position to an extended position to engage a document which is on a receiving platform to push the document through an opening in the receiving platform and towards a stacking platform to stack the document on the stacking platform. The plunger moves from the extended position back to the retracted position to allow a biasing force which is acting on the stacking platform to press the document which has just been stacked on the stacking platform against the receiving platform. A supporting mechanism supports first and second plate members of the receiving platform for pivoting movement between a non-parallel position in which the plate members form a substantially wide V-shape to cup the document as the plunger pushes the document through the opening and onto the stacking platform, and a parallel position in which the plate members are substantially parallel to each other as the plunger moves back to the retracted position to allow the biasing force which is acting on the stacking platform to press the document which has just been stacked on the stacking platform against the receiving platform.

4 Claims, 20 Drawing Sheets

DOCUMENT STACKER APPARATUS AND METHOD OF STACKING DOCUMENTS

This application is a continuation application of application Ser. No. 11/016,789 filed Dec. 20, 2004 now U.S. Pat. No. 7,229,071.

BACKGROUND OF THE INVENTION

The present invention relates to stacking documents in a self-service environment, such as stacking checks which have been deposited at a check depositing automated teller machine (ATM), and is particularly directed to a document stacker apparatus and method of stacking documents such that the documents are stacked in sequence relative to each other.

In a typical known check depositing ATM, a user is allowed to deposit a check (without having to place the check in any deposit envelope) in a publicly accessible, unattended environment. To deposit a check, the user inserts a user identification card through a user card slot at the check depositing ATM, enters the amount of the check being deposited, and inserts the check to be deposited through a check slot. A check transport mechanism receives the inserted check and transports the check in a forward direction along a check transport path to a number of locations within the ATM to process the check.

If the check is not accepted for deposit, the check transport mechanism transports the check in a reverse direction along the check transport path to return the check to the user via the check slot. If the check is accepted for deposit, the amount of the check is deposited into the user's account and the check is transported to a document storage bin within the ATM. An endorser printer prints an endorsement onto the check as the check is being transported to and stored in the storage bin. Checks in the storage bin within the ATM are periodically picked up and physically transported via courier to a back office facility of a financial institution for further processing.

When the check is transported to the storage bin, the condition of the check may cause the check to crumple or curl up as the check moves into the storage bin. The tendency of the check to crumple or curl up as the check moves into the storage bin may depend upon how empty or full the storage bin is at the time the check is moving into the storage bin. The tendency of the check to crumple or curl up usually increases as the storage bin becomes fuller.

A number of problems may be created when the check crumples or curls up as the check moves into the storage bin. One problem is that a document jam may occur when subsequent checks are later diverted into the storage bin. Another problem is that the effective storage capacity of the storage bin may be reduced. The effective storage capacity of the storage bin may be reduced since a crumpled or curled up check usually takes up more storage space in the storage bin than a check which is neither crumpled nor curled up. Still another problem is that the order in which checks were received in the document storage bin may be lost. When the order is lost, additional time is usually required later at the back office facility of the financial institution to sort the checks back into the order in which the checks were received in the storage bin. It would be desirable to provide a type of storage bin in which deposited checks are reliably stacked in the order received, and in which the capacity of the storage bin is more fully utilized independent of the conditions of the deposited checks.

SUMMARY OF THE INVENTION

In accordance with one aspect of the present invention, a method is provided for operating a document stacker having a first platform, a second platform which is disposed on one side of the first platform and which is biased towards the first platform, and a plunger which is disposed on an opposite side of the first platform and which is movable relative to the first platform. The method comprises receiving a document on the first platform, moving the plunger towards the first platform to push the document through an opening in the first platform and towards the second platform to stack the document on the second platform, and moving the plunger away from the second platform and back through the opening in the first platform to allow the biasing force acting on the second platform to compress the document between the first and second platforms and thereby to reduce the chance of a stacking defect from occurring when a succeeding document is subsequently stacked on top of the document which has just been stacked on the second platform. The method may further comprise changing position of the first platform such that the first platform cups the document as the document is being pushed through the opening in the first platform and stacked on the second platform. The method may also comprise frictionally engaging the document as the position of the first platform is being changed and the document is being pushed through the opening in the first platform to stiffen the document before the document is stacked on the second platform.

In accordance with another aspect of the present invention, a document stacker apparatus comprises a stacking platform on which documents can be stacked, a receiving platform having an opening and on which a document is received for stacking on the stacking platform, a biasing mechanism which biases the stacking platform towards the receiving platform, and a-plunger movable between a retracted position and an extended position. The document stacker apparatus further comprises an actuatable drive mechanism for, when actuated a first time, moving the plunger from the retracted position to the extended position to engage a document which is on the receiving platform to push the document through the opening in the receiving platform and towards the stacking platform to stack the document on the stacking platform and for, when actuated a second time which is after the first time, moving the plunger from the extended position back to the retracted position to allow the biasing force which is acting on the stacking platform to press the document which has just been stacked on the stacking platform against the receiving platform and thereby to reduce the chance of a stacking defect from occurring when a succeeding document is subsequently stacked on the document which has just been stacked on the stacking platform. The first platform may include a first plate member and a second plate member adjacent to the first plate member such that the opening is defined between the first and second plate members. The document stacker apparatus may further comprise a supporting mechanism which supports the first and second plate members for pivoting movement between a non-parallel position in which the plate members form a substantially wide V-shape to cup the document as the plunger pushes the document through the opening and onto the stacking platform, and a parallel position in which the plate members are substantially parallel to each other as the biasing force which is acting on the stacking platform presses the document which has just been stacked on the stacking platform against the receiving platform after the plunger has returned to the retracted position.

In accordance with yet another aspect of the present invention, a document stacker apparatus comprises a first platform including first and second plate members movable between a parallel position in which-the plate members lie substantially parallel to each other so that a document can be received on the first platform, and a non-parallel position in which the plate members form a substantially wide V-shape so that a document which has been received on the first platform can be cupped, each of the first and second plate members including a surface edge which defines an opening in the first platform. The document stacker apparatus also comprises a second platform movable between a position in which a stack of documents on the second platform is compressed between the second platform and the first and second plate members of the first platform, and another position in which the stack of documents is away from the first and second plate members. The document stacker apparatus further comprises a plunger movable between a retracted position and an extended position and for (i) pushing a document through the opening in the first platform and onto the stack of documents on the second platform as the plunger moves from the retracted position to the extended position, (ii) pushing the stack of documents on the second platform away from the first and second plate members of the first platform to allow the first and second plate members to move from the parallel position to the non-parallel position and thereby to cup the document as the document is being pushed through the opening in the first platform. The document stacker apparatus may further comprise a drive mechanism which is operable in one direction to move the plunger from the retracted position to the extended position and operable in an opposite direction to moves the plunger from the extended position to the retracted position. The document stacker apparatus may further comprise a biasing mechanism which biases the second platform towards the first platform such that the biasing force of the biasing mechanism moves the second platform and any stack of documents on the second platform towards the first and second plate members of the first platform to compress the stack of documents between the first and second platforms and thereby to move the first and second plate members from the non-parallel position back to the parallel position. The plunger may comprise (i) a transverse member which contacts the document being pushed through the opening in the first platform as the plunger is moving from the retracted position to the extended position, and (ii) a pair of cross members which form a scissor mechanism having one end connected to the transverse member and an opposite end coupled to the drive mechanism such that the scissor mechanism closes to extend the transverse member through the opening in the first platform when the drive mechanism is operated in the direction to move the plunger from the retracted position to the extended position and opens to retract the transverse member through the opening in the first platform when the drive mechanism is operated in the opposite direction to move the plunger from the extended position back to the retracted position.

In accordance with still another aspect of the present invention, a method of operating an automated teller machine (ATM) comprises receiving a check from an ATM customer, endorsing the check, transporting the endorsed check to a first platform of a stacker, pushing the check through an opening in a first platform to stack the check on a second platform which is biased towards the first platform, and after the check has been stacked on the second platform, allowing the biasing force which is acting on the second platform to compress the stacked check between the first and second platforms to reduce the chance of a stacking defect from occurring when a succeeding check is subsequently stacked on top of the check which has just been stacked. The method may further comprise frictionally engaging the check to stiffen the check as the check is being pushed through the opening in the first platform. The method may also comprise reading a magnetic ink character recognition (MICR) codeline from the check before the check is endorsed.

BRIEF DESCRIPTION OF THE DRAWINGS

These and other aspects of the present invention will be apparent from the following specific description, given by way of example, with reference to the accompanying drawings, in which.

DETAILS OF THE INVENTION

The present invention relates to stacking documents in a self-service environment, such as stacking checks which have been deposited at a check depositing automated teller machine (ATM), and is particularly directed to a document stacker apparatus and method of stacking documents such that the documents are stacked in sequence relative to each other.

Figure 1:
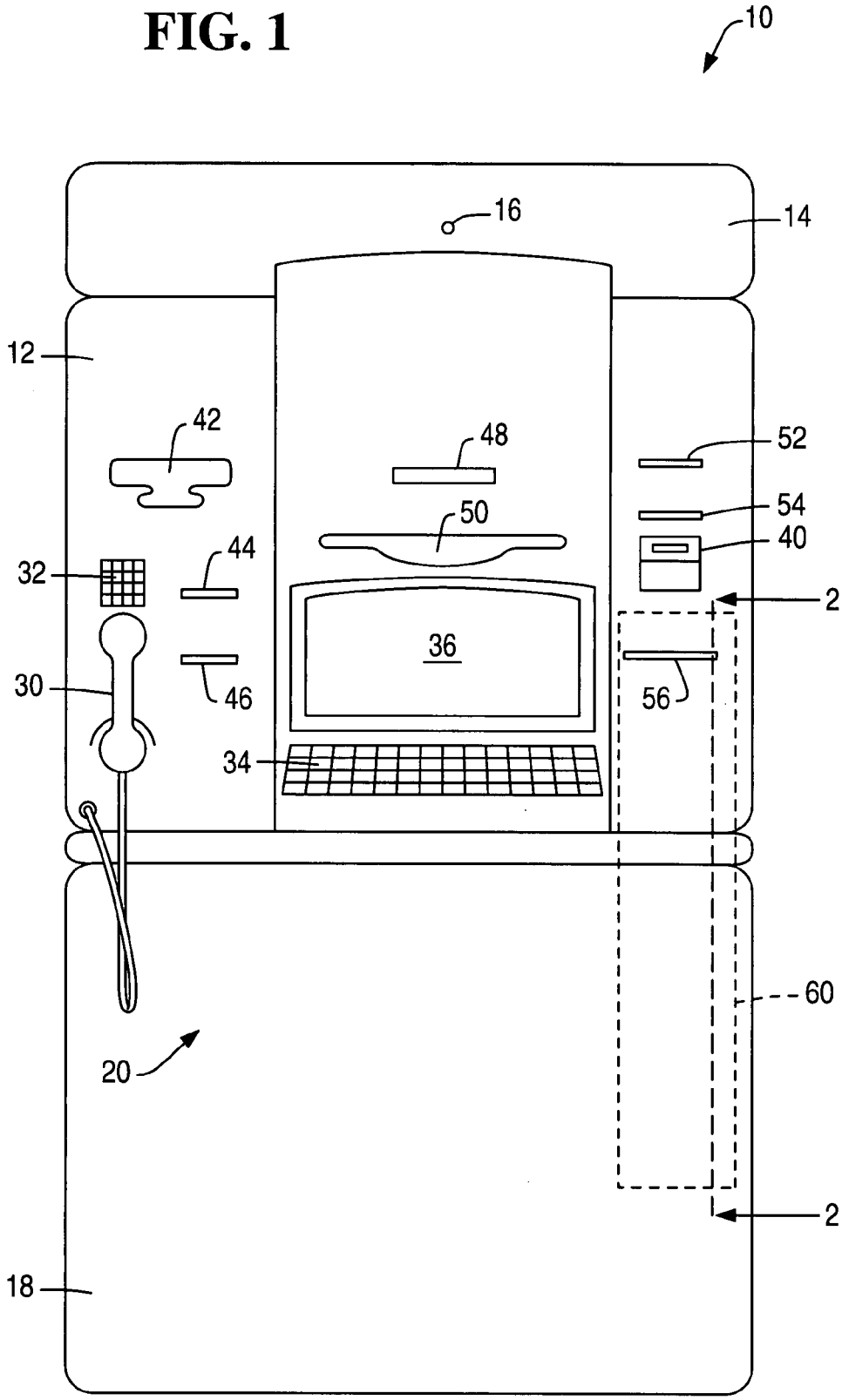
FIG. 1 is a pictorial diagram of an image-based check depositing ATM embodying the present invention.

Referring to FIG. 1, a self-service terminal 10 in the form of an image-based check depositing ATM is illustrated. The check depositing ATM 10 comprises a fascia 12 pivotably coupled to a chassis (not shown), an upper panel 14 mounted to the chassis and defining an aperture 16 through which a camera (not shown) images a user of the ATM 10, and a lower panel 18 hingeably coupled to the chassis so that the lower panel can be opened to reveal a safe (not shown) mounted in the chassis. When the lower panel 18 is open, the fascia 12 can be pivoted upwards to reveal ATM modules mounted within the chassis.

The fascia 12 and lower panel 18 provide a user interface 20 for allowing a user to execute a transaction. The fascia 12 includes a handset 30 and a telephone keypad 32 for allowing a user to contact a remote operator (not shown) typically located in a call center (not shown). The fascia 12 also includes an encrypting keyboard 34 for allowing a user to enter transaction details, and a display 36 for presenting screens to a user. The fascia 12 also defines a number of slots for receiving and dispensing media items, and a tray 40 into which coins can be dispensed. The slots include a money order printer slot 42, a bunch note input slot 44, a bunch note exit slot 46, a statement output slot 48, a cash dispense slot 50, a card reader slot 52, a card issue slot 54, and a check input/output slot 56. The slots 42 to 56 and tray 40 are arranged so that when the fascia 12 is closed, the slots and tray align with corresponding ATM modules mounted within the ATM's chassis (not shown). The user interface features described above are all provided on an NCR PERSONAS (trade mark) 5878 financial services center ATM, available from NCR Financial Solutions Group Limited, Discovery Centre, 3 Fulton Road, Dundee, DD2 4SW, Scotland.

Figure 2:
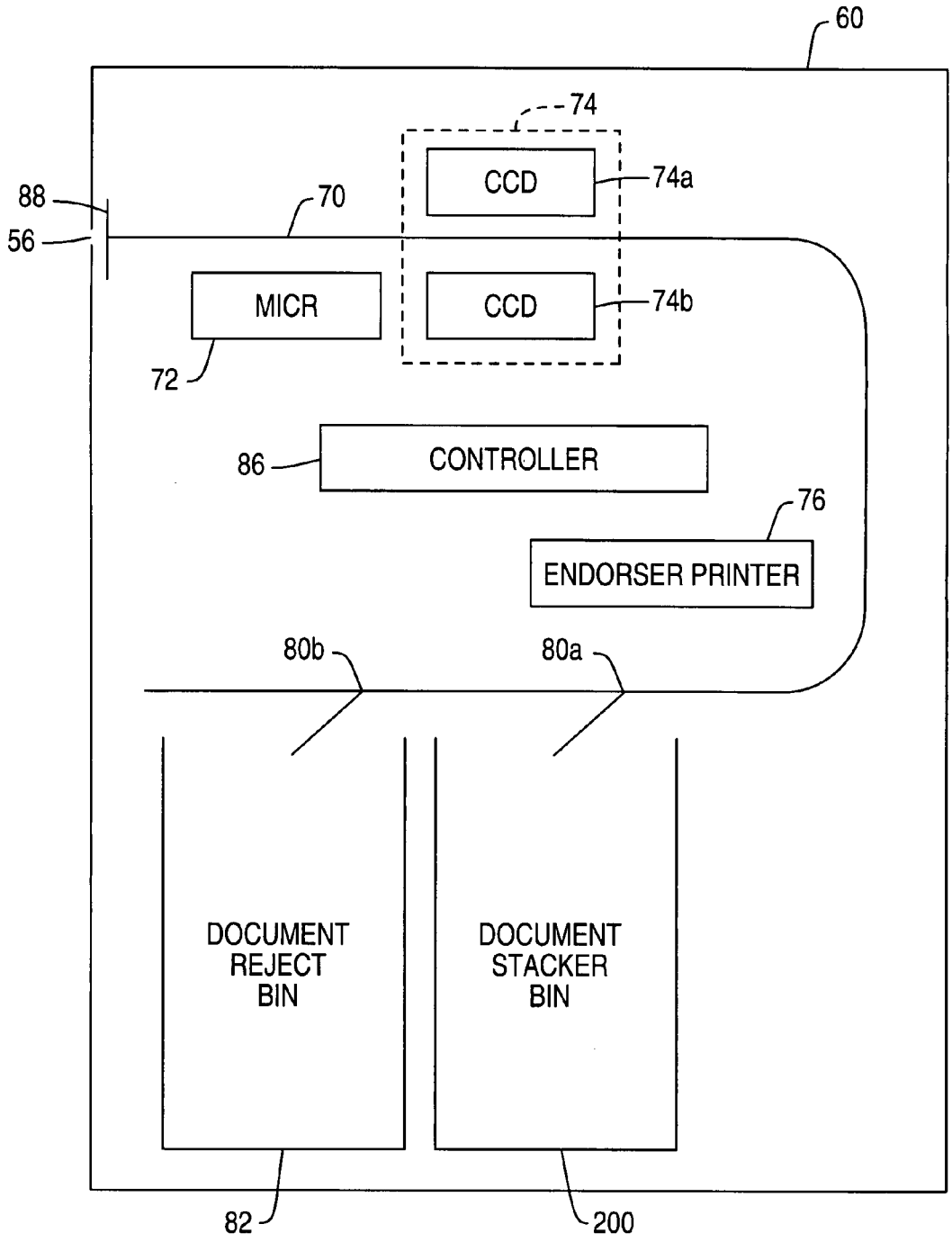
FIG. 2 is a simplified schematic sectional diagram, taken approximately along line 2-2 in FIG. 1, and showing a part (the check processing module) of the ATM of FIG. 1.
Figure 3:
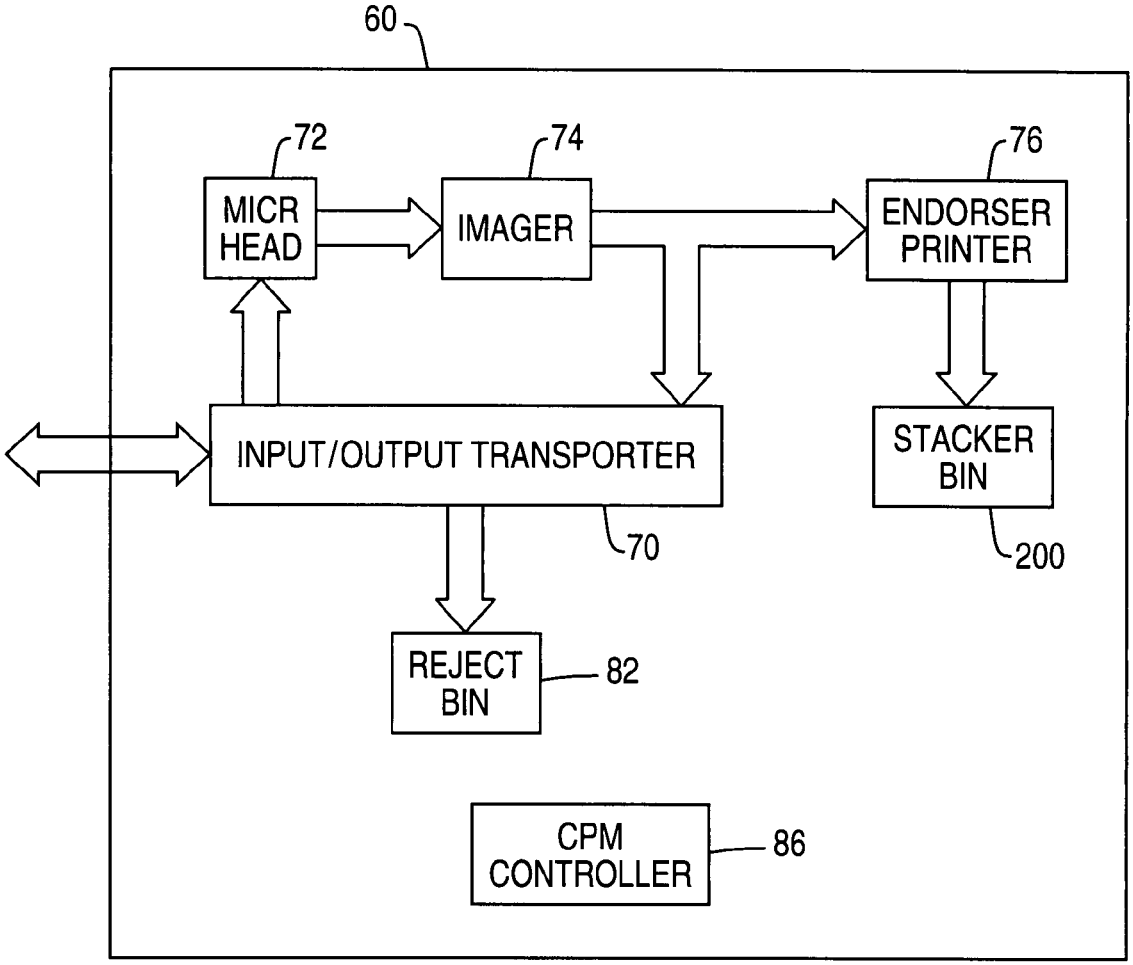
FIG. 3 is a block diagram of the check processing module of FIG. 2.

A check processing module (CPM) 60 will now be described with reference to FIG. 2 and FIG. 3. FIG. 2 is a simplified schematic sectional diagram (along line 2-2 in FIG. 1) showing part of the fascia 12 and lower panel 18, and the main parts of the CPM 60. FIG. 3 is a block diagram illustrating the main elements in the CPM 60. The CPM 60 is a modified version of a conventional check processing module, such as the check processing module provided with the PERSONAS (trade mark) 5878 NCR ATM. The CPM 60 comprises a check input/output transport mechanism 70 including an alignment mechanism for aligning a check, a magnetic ink recognition character (MICR) head 72 for reading magnetic details on a code line of a check, an imager 74 including an upper 74*a* and lower 74*b* CCD camera for capturing an image of each side of a check (front and rear), and a printer 76 for endorsing a check.

The CPM 60 further comprises a document stacker bin 200 for storing processed checks, and a document reject bin 82 for storing rejected checks. The transport mechanism 70 includes two divert gates 80*a*, 80*b* for diverting checks to either the document stacker bin 200 or the document reject bin 82. The elements other than the document stacker bin 200 are conventional and will not be described in detail herein. The structure and operation of the document stacker bin 200 will be described in detail later. The CPM 60 also includes a controller 86 for controlling the operation of the elements within the CPM 60. The CPM 60 also includes an entrance shutter 88 for opening and closing the check input/output slot 56.

Figure 4:
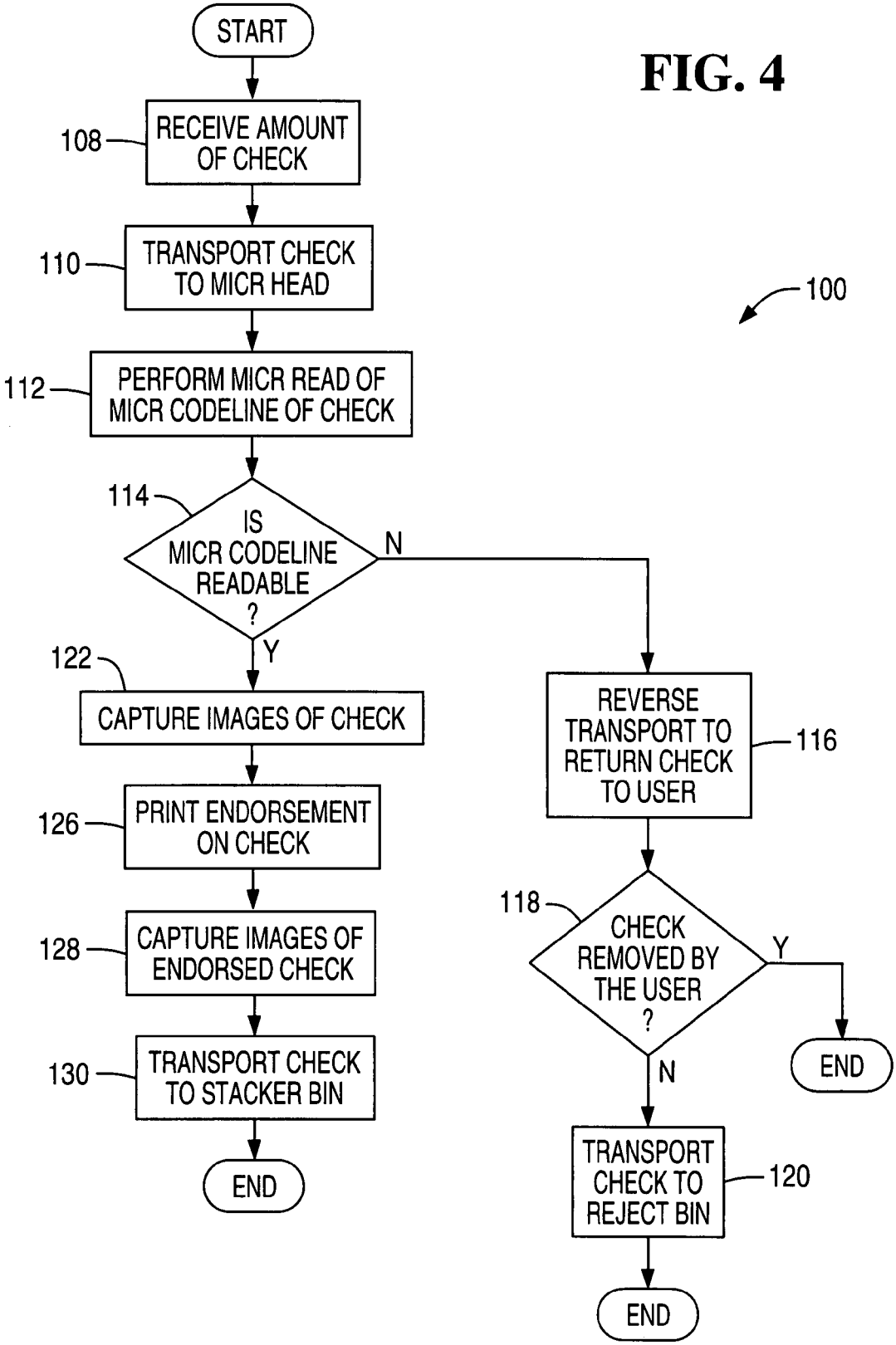
FIG. 4 is a flowchart illustrating steps involved in a check depositing operation.

A typical depositing transaction will now be described with reference to FIG. 4 which is a flowchart 100 illustrating the steps involved in a check depositing transaction, and also with reference to FIGS. 1 to 3. In this transaction, the user enters user identification card into the card reader slot 52, selects "check depositing" from a list of transaction options presented on the display 36, enters the amount of the check via the keyboard 34, and inserts the check to be deposited through the check input/output slot 56. The controller 86 receives the amount of the check (step 108), and opens the slot shutter 88. The transport mechanism 70 receives the check and transports the received check (step 110) to the MICR head 72 where the MICR codeline on the check is read (step 112).

A determination is made (step 114) as to whether the MICR codeline can be read from the check. If the MICR codeline data from the check is unreadable as determined in step 114, then a check return operation is initiated. When this occurs, the transport mechanism 70 reverses the direction of transport (step 116) to convey the check to the check input/output slot 56 to return the check to the user via the check input/output slot. The controller 86 may monitor the slot 56 to ensure that the check has been removed by the user (step 118). If the user has not removed the check within a predetermined time period, the check is retracted and conveyed to the document reject bin 82 (step 120).

However, if the MICR codeline data from the check is readable as determined in step 114, then the transport mechanism 70 transports the check to the imager 74, where both sides of the check are imaged (step 122). The printer 76 prints endorsement data onto the check (step 126). The check is then transported to the imager 74 to image the endorsed check (step 128) before it is transported to the document stacker bin 200 (step 130) for subsequent collection and further processing. Although the above describes both steps 122 and 128 being performed, it is conceivable that only one of these steps be performed. Preferably, step 122 is performed, and step 128 is optionally performed.

Figure 5:
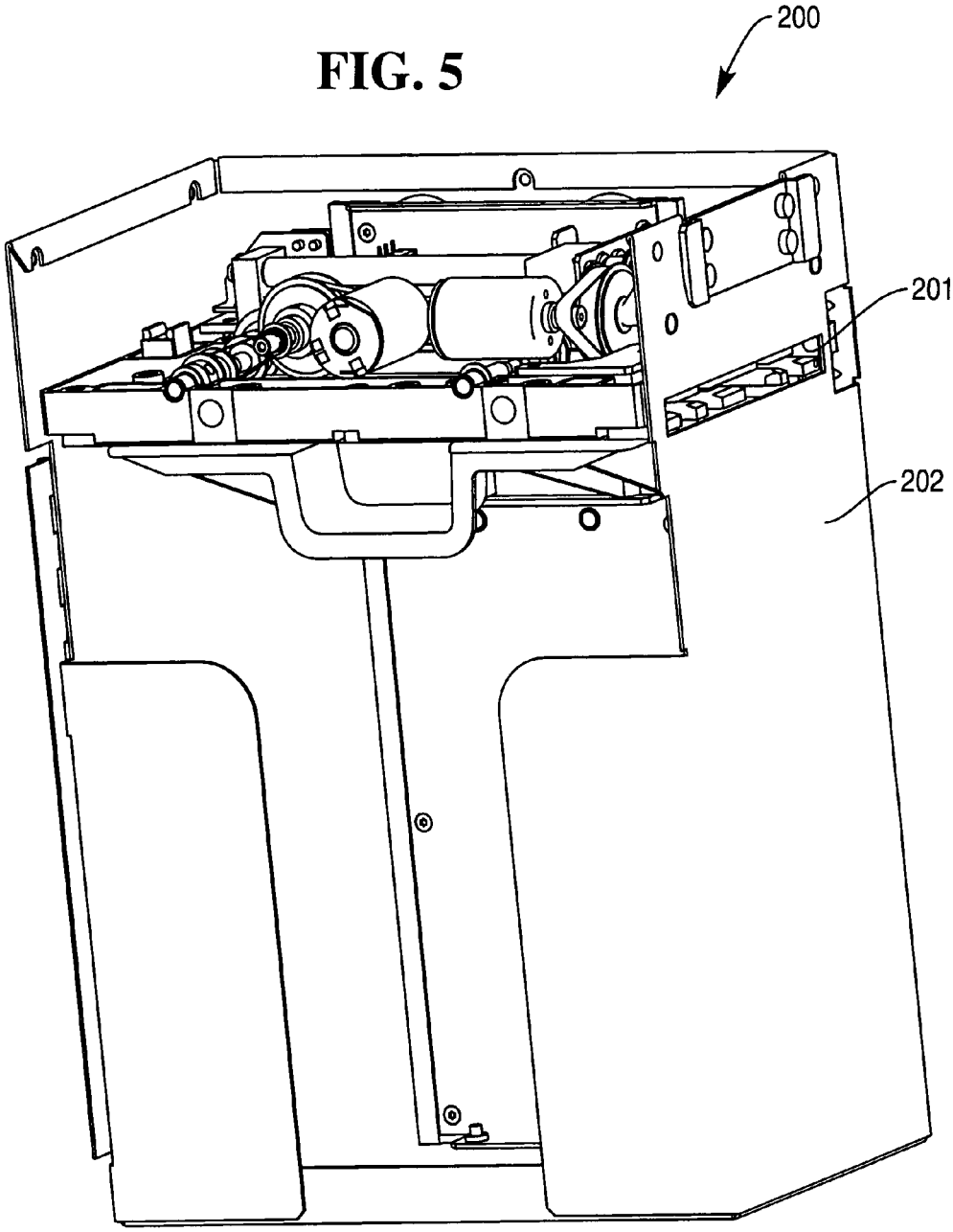
FIG. 5 is perspective view of a document stacker bin used in the ATM of FIG. 1.
Figure 6:
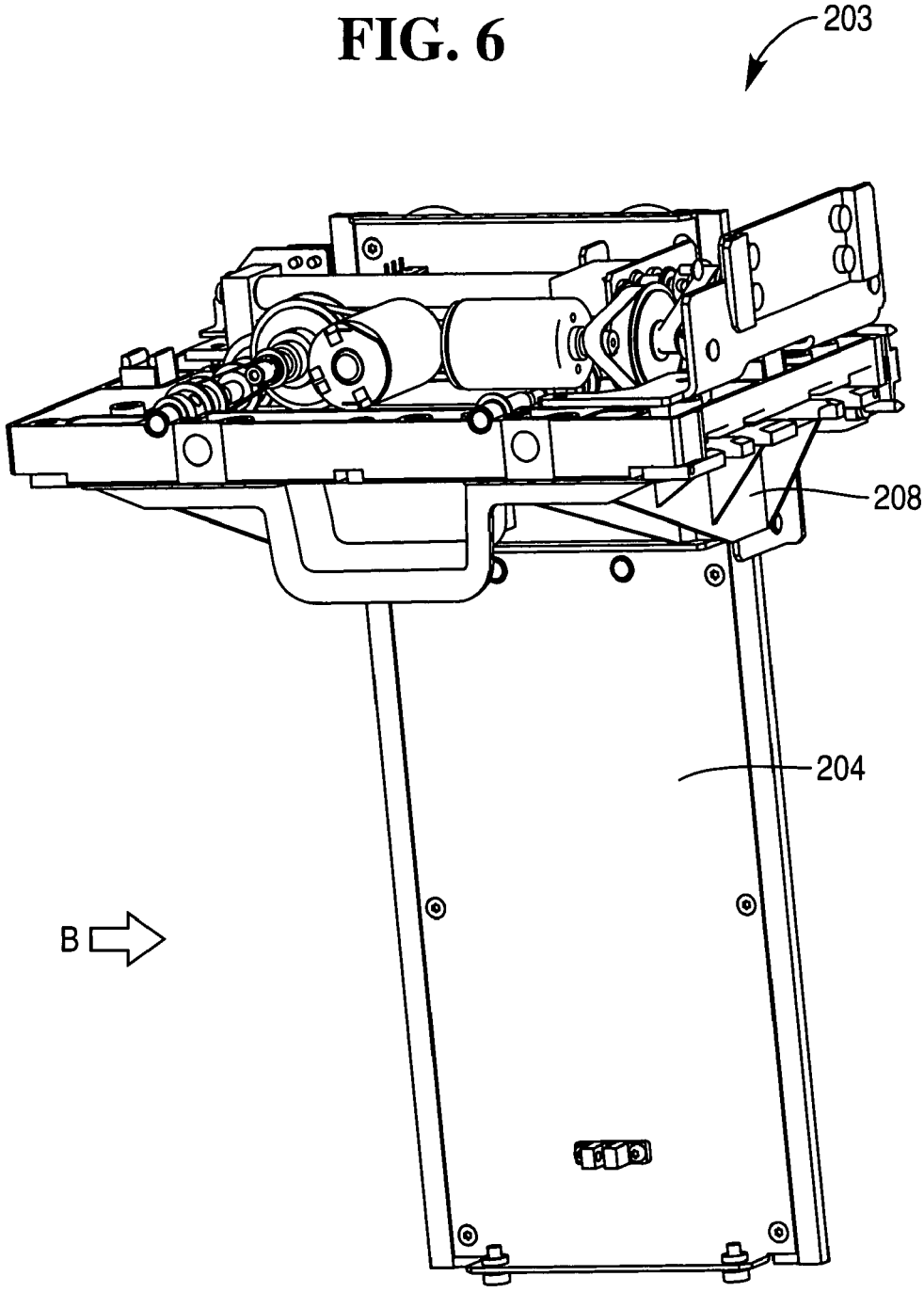
FIG. 6 is a view similar to FIG. 5, and showing an enclosure panel removed to expose interior components of the document stacker bin.
Figure 7:
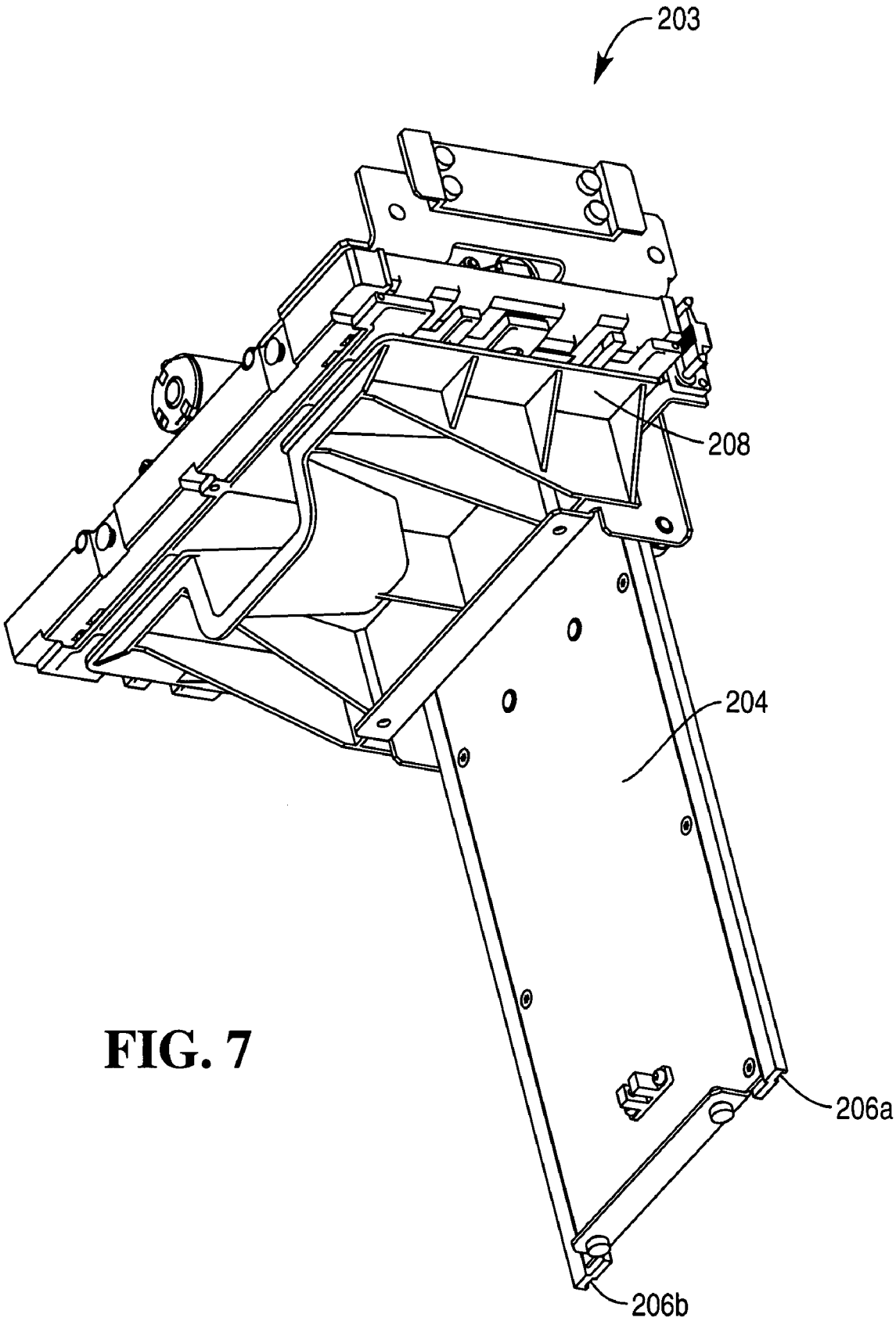
FIG. 7 is a perspective view looking generally from the lower, right-side of FIG. 6.

Referring to FIG. 5, the document stacker bin 200 is illustrated. The stacker bin 200 includes a removable enclosure panel 202 having a slot 201 through which a check is received when the check is diverted to the stacker bin 200. When the enclosure panel 202 is removed as shown in FIG. 6, an operator can access interior components 203 of the stacker bin 200. FIG. 7 is a different perspective view from the lower, right-side (as viewed looking at FIG. 6) of FIG. 6 to illustrate some details not visible in FIG. 6. Similarly, FIG. 8 is another perspective view from the upper, rear, right-side of FIG. 6 to illustrate other details not visible in either FIG. 6 or FIG. 7.

Figure 8:
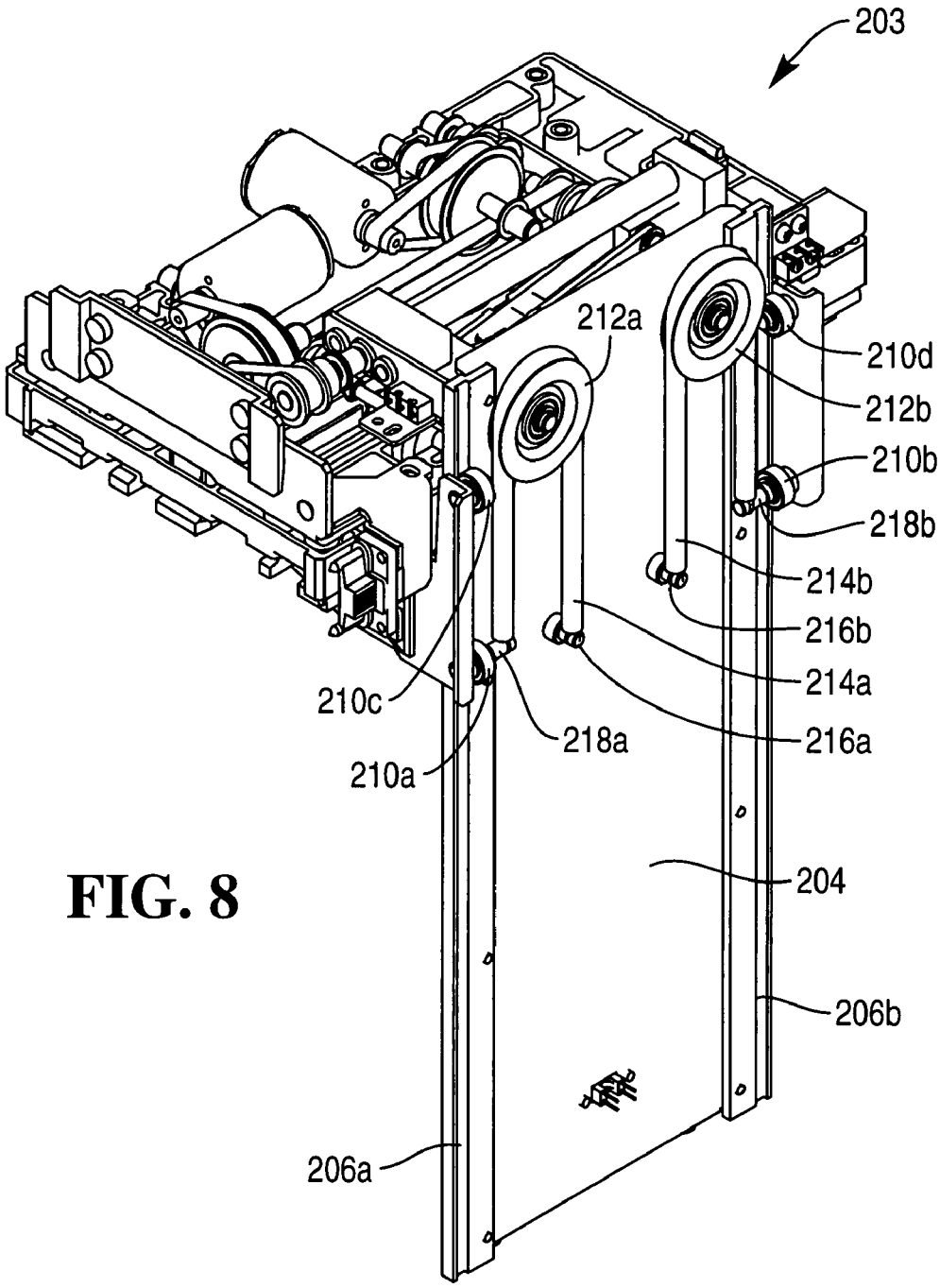
FIG. 8 is a perspective view looking generally from the upper, rear, right-side of FIG. 6.

As shown in FIGS. 6-8, the stacker bin 200 includes a base plate 204 having a pair of slide rails 206*a*, 206*b* disposed on the back side (FIG. 8) of the base plate. A stacking platform 208 is slidably mounted via four slide rollers 210*a*, 210*b*, 210*c*, 210*d* to the pair of slide rails 206*a*, 206*b*. As shown in FIG. 8, the two slide rollers 210*a*, 210*c* are slidable along the slide rail 206*a*, and the two slide rollers 210*b*, 210*d* are slidable along the slide rail 206*b*.

A pair of pulleys 212*a*, 212*b* is connected to the back side (FIG. 8) of the base plate 204. A pair of resilient members 214*a*, 214*b* extends around the pair of pulleys 212*a*, 212*b*. The resilient member 214*a* extends around the pulley 212*a*, and the resilient member 214*b* extends around the pulley 212*b*. One end of the resilient member 214*a* is connected to a stud 216*a* which, in turn, is fixedly attached to the base plate 204. The other end of the resilient member 214*a* is connected to a stud shaft 218*a* of the slide roller 210*a*. Similarly, one end of the resilient member 214*b* is connected to a stud 216*b* which, in turn, is fixedly attached to the base plate 204. The other end of the resilient member 214*b* is connected to a stud shaft 218*b* of the slide roller 210*b*.

Figure 9:
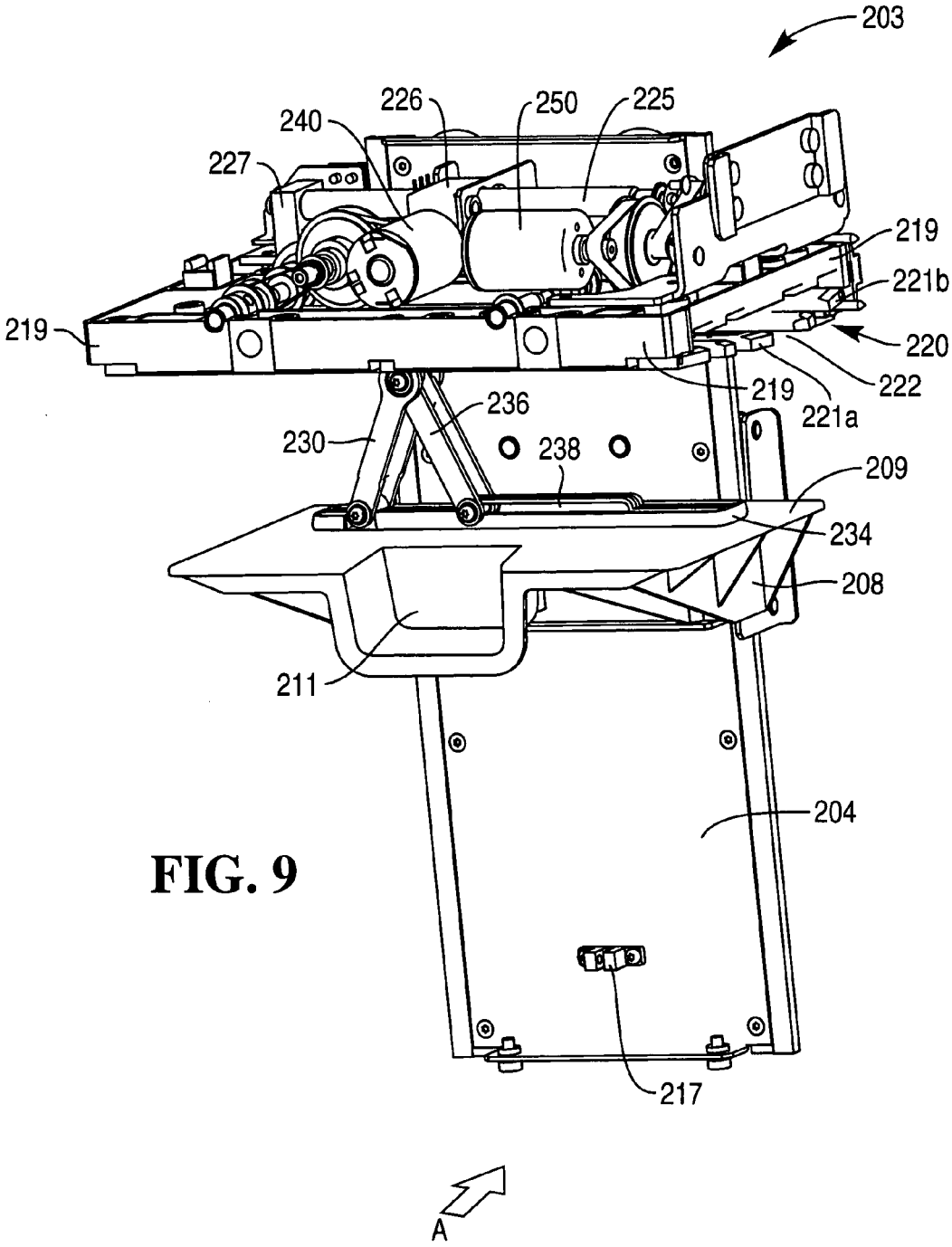
FIG. 9 is a view similar to FIG. 6, and showing parts in a different position.
Figure 10:
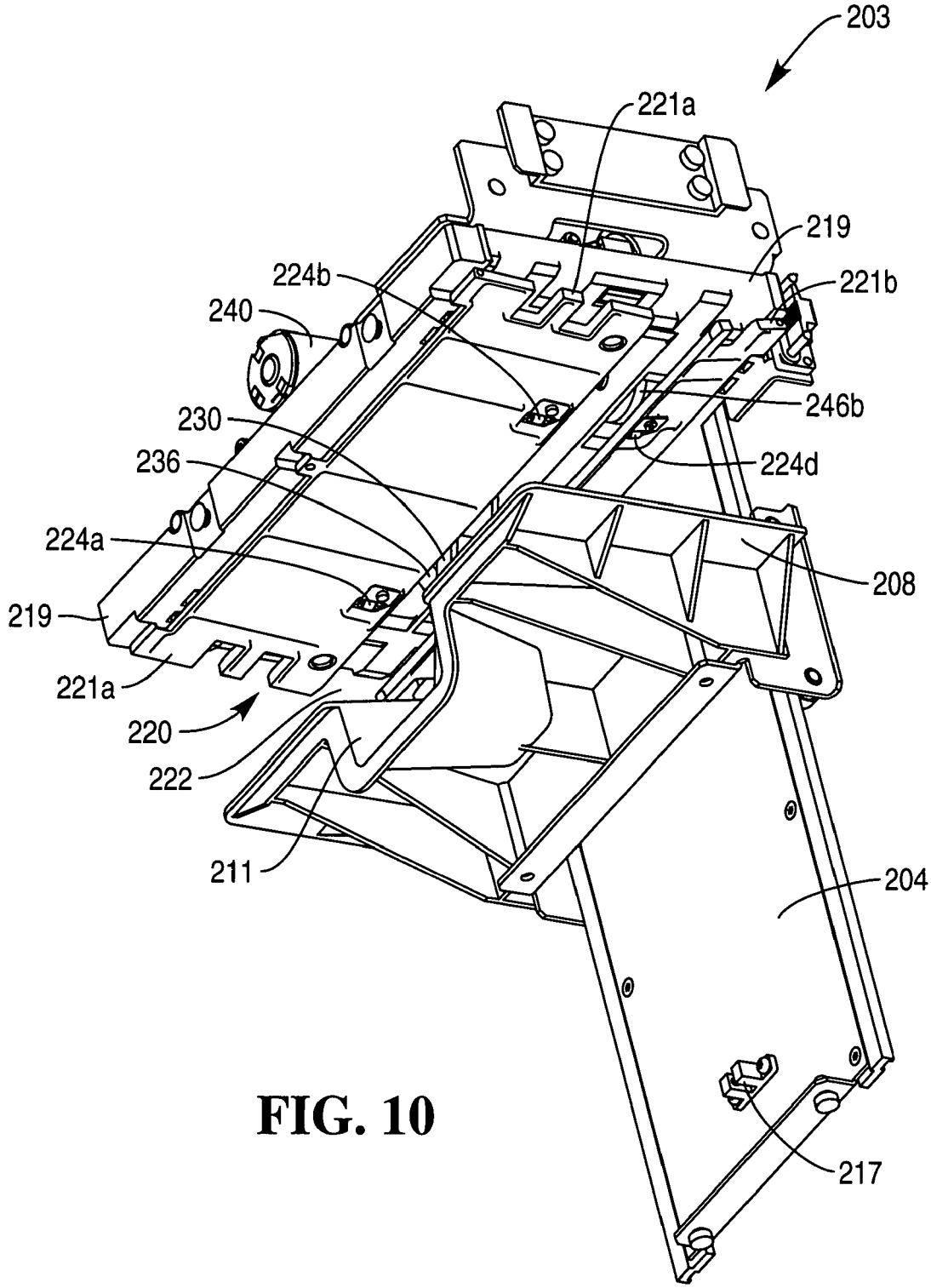
FIG. 10 is a view similar to FIG. 7, and showing parts in a different position.
Figure 11:
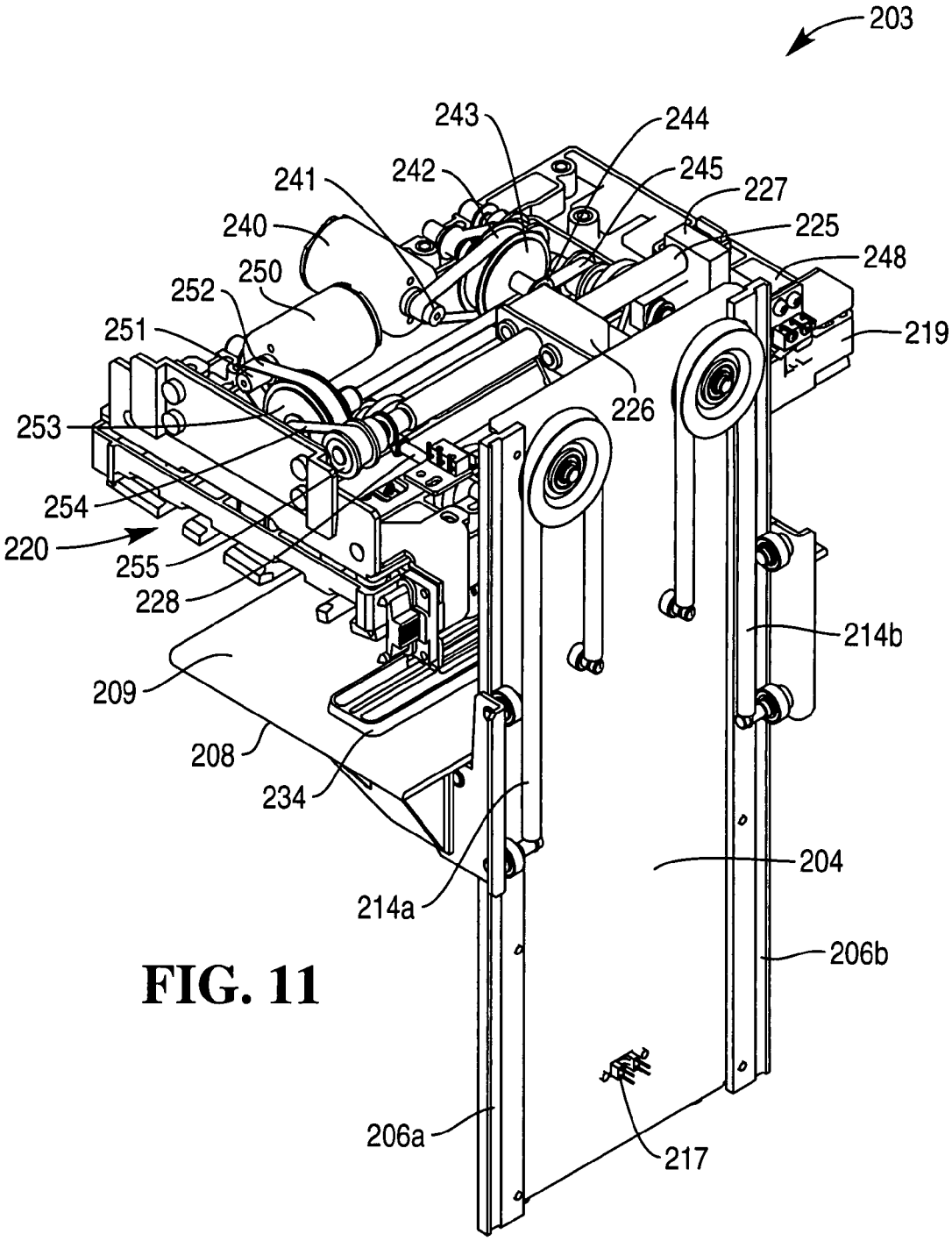
FIG. 11 is a view similar to FIG. 8, and showing parts in a different position.

FIGS. 9-11 correspond to FIGS. 6-8, respectively, and show the stacking platform 208 in a lowered position along the slide rails 206*a*, 206*b*. The stacking platform 208 has a major surface 209 on which checks diverted to the stacker bin 200 can be stacked. The platform member 208 also has an indented surface 211 disposed approximately in a central area of the major surface 209. The indented surface 209 allows a user to place a finger underneath a stack of checks stacked on the major surface 209 so that the user can easily pick up and remove the stack of checks.

When a stack of checks on the major surface 209 of the stacking platform 208 becomes fuller, the weight of the stack of check tends to move the stacking platform towards the bottom (as viewed looking at FIG. 9) of the base plate 204. A sensor 217 is located in the bottom area of the base plate 204. When the weight of the stack of checks on the stacking platform 208 is sufficient to move the stacking platform into the bottom area of the base plate 204, the sensor 217 detects presence of the stacking platform and a signal is provided to indicate a full stack of checks on the stacking platform. The weight of the stack of checks on the stacking platform 208 stretches the resilient members 214*a*, 214*b* and thereby tensions the resilient members 214*a*, 214*b*. The tension acting on the resilient members 214*a*, 214*b* tends to return the stacking platform 208 from the position shown in FIGS. 9-11 back to the position shown in FIGS. 6-8.

Figure 12:
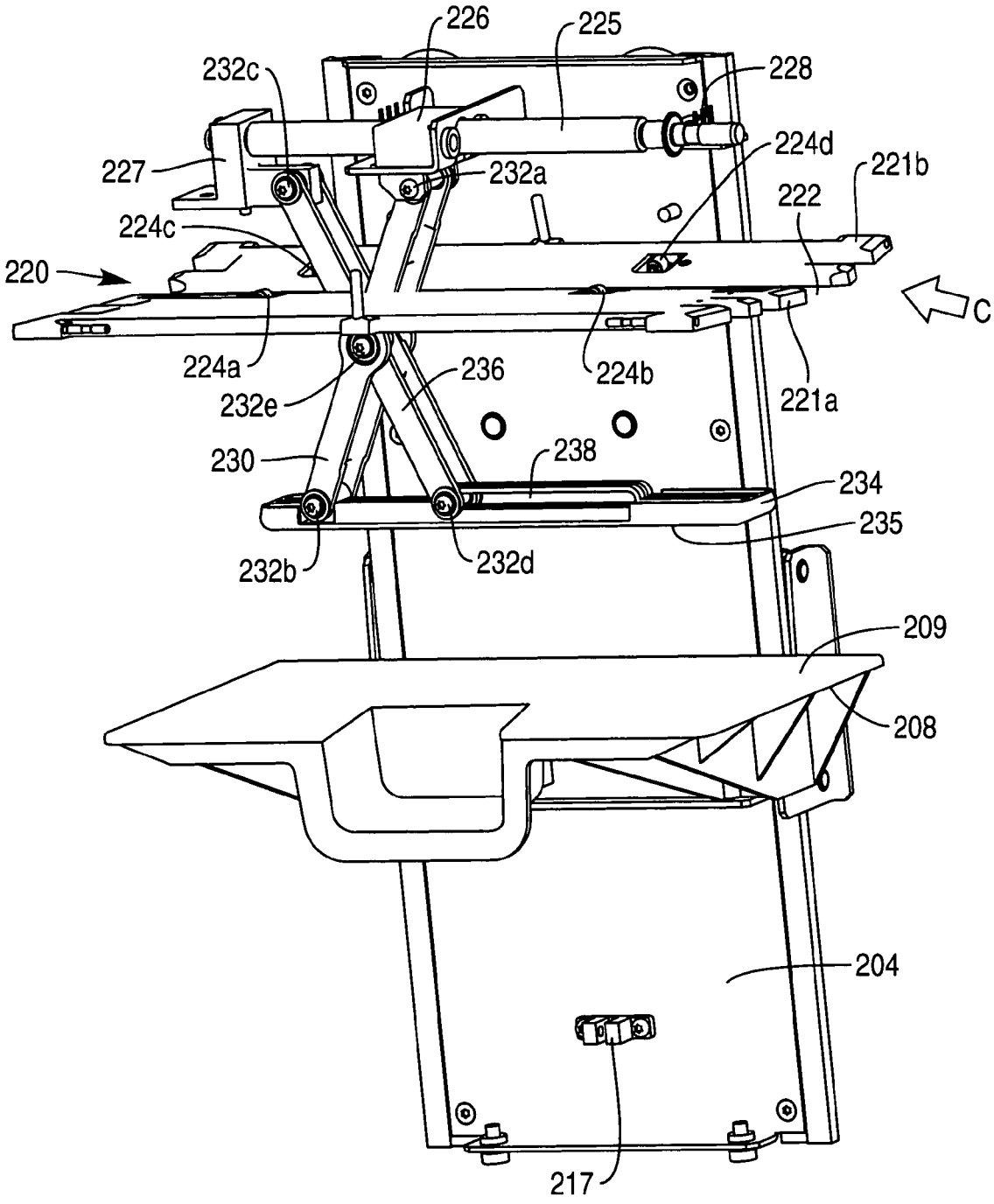
FIG. 12 is a view similar to FIG. 9, and showing some parts in a different position and some parts removed to better illustrate certain parts.
Figure 13:
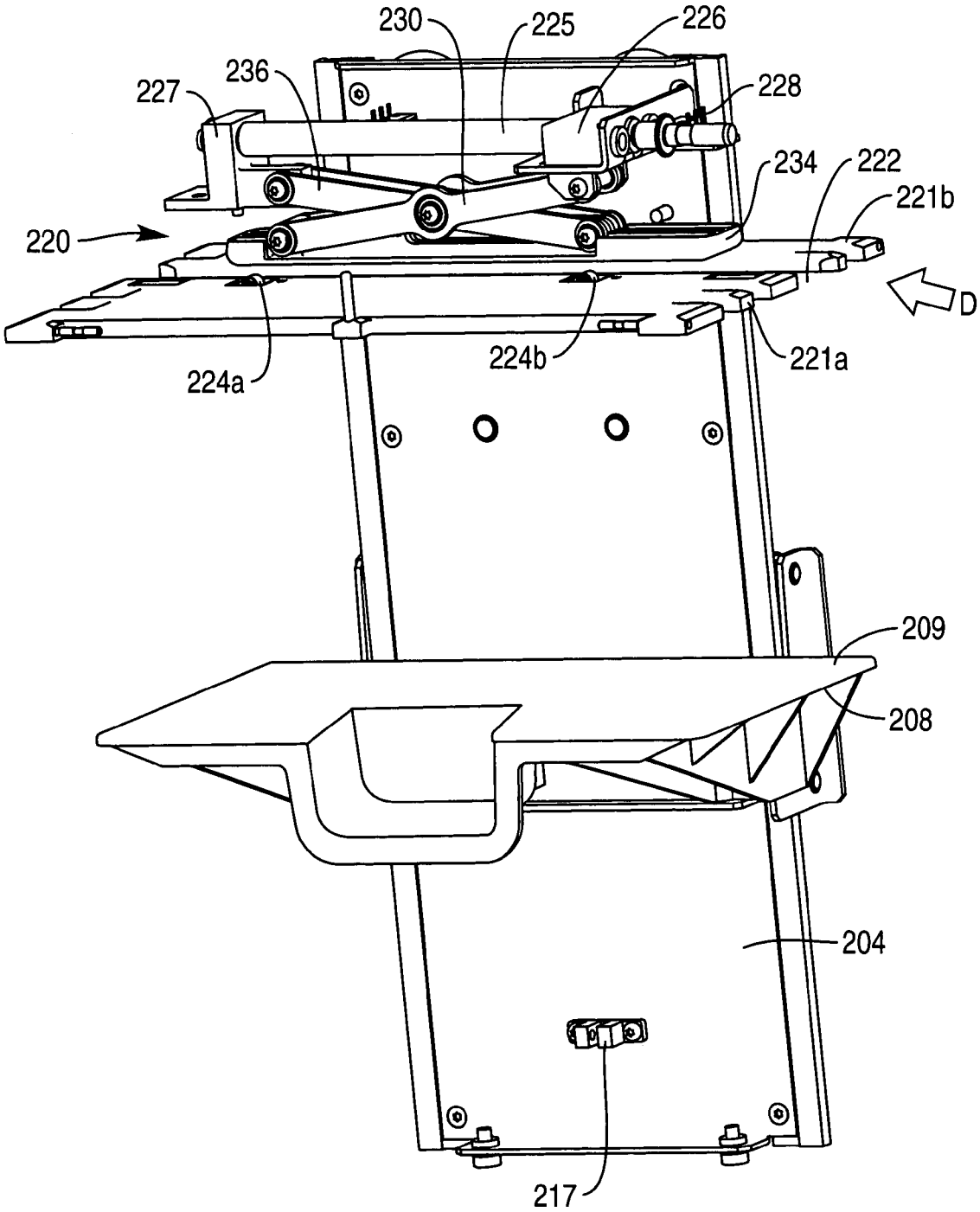
FIG. 13 is a view similar to FIG. 12, and showing certain parts in a different position.

Referring to FIGS. 9-13, a supporting frame 219 is fixedly attached to the base plate 204. A receiving platform 220 comprises a pair of plates 221*a*, 221*b* with an opening 222 between the plates. The plate 221*a* has a pair of idler rollers 224*a*, 224*b* disposed therein, and the plate 221*b* has a pair of idler rollers 224*c*, 224*d* disposed therein. The supporting frame 219 supports the plates 221*a*, 221*b* for pivotal movement between an operating position as shown in FIG. 12 and a non-operating position as shown in FIG. 13. In the operating position as shown in FIG. 12, the plates 221*a*, 221*b* are non-parallel with each other and form a substantially wide V-shape profile, looking approximately in the direction of arrow C in FIG. 12. In the non-operating position as shown in FIG. 13, the plates 221*a*, 221*b* are substantially parallel with each other and form a substantially flat shape profile, looking approximately in the direction of arrow D in FIG. 13.

As shown in FIG. 12, a first shaft support 227 is fixedly attached to the supporting frame 219 (FIGS. 9-11), and supports one end of a threaded rod 225. A second shaft support 228 is fixedly attached to the base plate 204, and supports the opposite end of the threaded rod 225. A threaded nut 226 is threadingly coupled to the threaded rod 225 such that the threaded nut can move between opposite ends of the threaded rod by rotation of the threaded rod about its longitudinal central axis. The threaded nut 226 moves toward one end of the threaded rod 225 when the threaded rod is driven to rotate in one direction about its longitudinal central axis. The threaded nut 226 moves toward the other end of the threaded rod 225 when the threaded rod is driven to rotate in the opposite direction about its longitudinal central axis.

One end of a first cross member 230 is pivotably connected via a pivot pin 232*a* to the threaded nut 226. An opposite end of the first cross member 230 is pivotably connected via a pivot pin 232*b* to an end portion of a plunger member 234. One end of a second cross member 236 is pivotably connected via a pivot pin 232*c* to the first shaft support 223. An opposite end of the second cross member 236 is connected via a pivot pin 232*d* which extends through an elongated slot 238 formed in approximately the central portion of the plunger member 234. The first and second cross members 230, 236 are interconnected via a pivot pin 232*e* to form a mechanism which can open and close like a pair of scissors to move the plunger member 234 between an extended position such as shown in FIG. 12 and the retracted position as shown in FIG. 13. The plunger member 234 has a bottom surface 235 which lies substantially parallel with the major surface 209 of the stacking platform 208.

Figure 14:
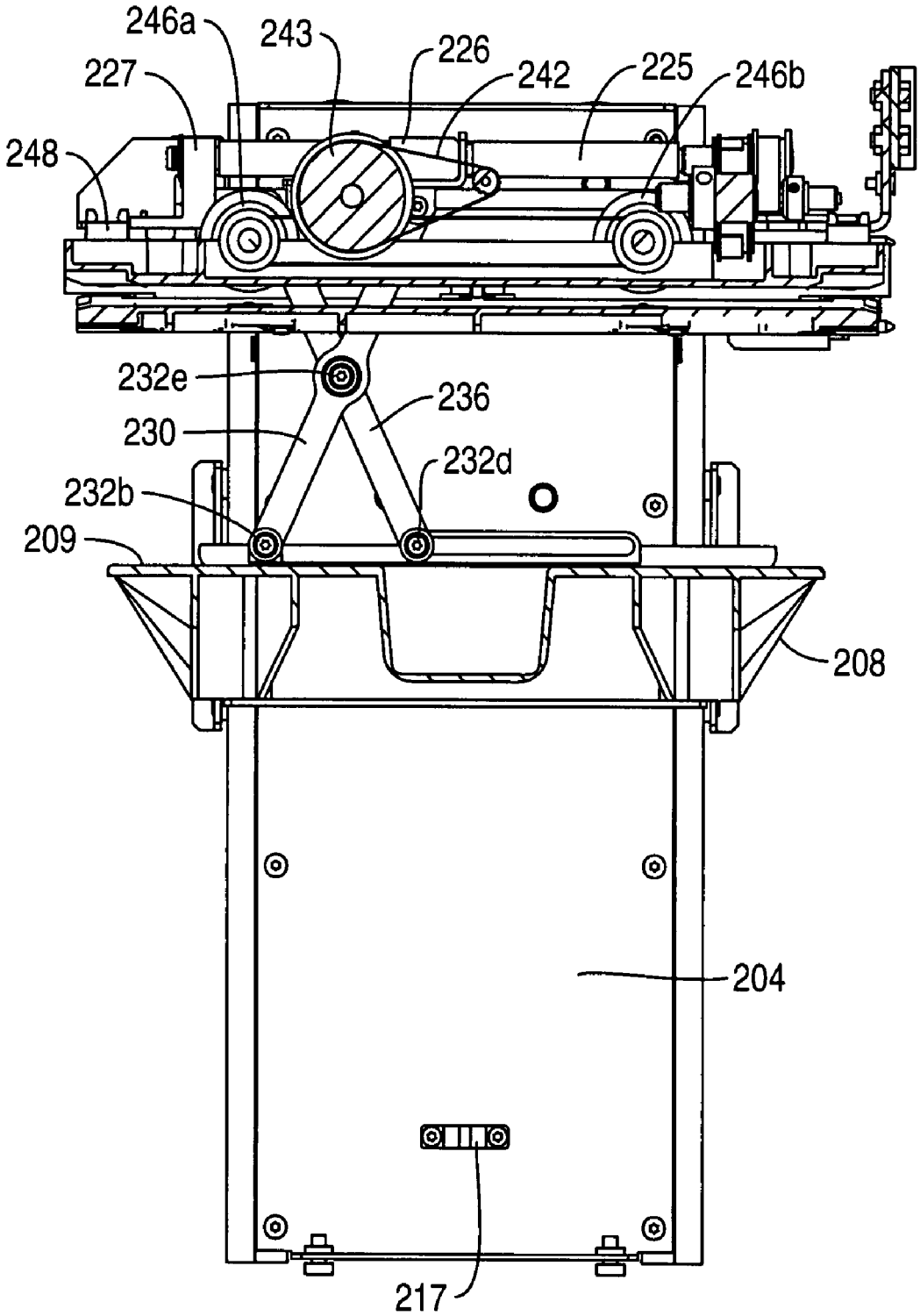
FIG. 14 is an elevational view with some parts in section, looking approximately in the direction of arrow A in FIG. 9.

Referring to FIGS. 11-14, an output shaft 241 of a first motor 240 is drivingly connected through a belt 242, a pulley 243, another pulley 244, and another belt 245 which, in turn, is drivingly connected to a pair of drive rollers 246*a*, 246*b* (FIG. 14). The controller 86 (FIGS. 2 and 3) controls operation of the first motor 240. When driven, the output shaft 241 of the first motor 240 is driven, the drive rollers 246*a*, 246*b* rotate in a direction to receive a check which has been diverted to the stacker bin 200. The driving force of the drive rollers co-operates with the pinching forces of the idler rollers 224*a*, 224*b* (FIG. 12) disposed in the first plate 221*a* and the idler rollers 224*c*, 224*d* disposed in the second plate 221*b* to position the check on the receiving platform 220. A sensor 248 (FIG. 11) detects the leading edge of the check and provides a signal indicative of the check being positioned on the receiving platform 220. The controller 86 halts operation of the first motor 240 and thereby halts operation of the drive rollers 246*a*, 246*b* when the sensor 248 detects the leading edge of the check and provides the signal indicative thereof.

An output shaft 251 of a second motor 250 is drivingly coupled through a belt 252, a pulley 253, another belt 254, and another pulley 255 to the threaded rod 225. The controller 86 (FIGS. 2 and 3) controls operation of the second motor 250. When the output shaft 251 of the second motor 250 is driven in one direction, the threaded rod 225 rotates about its longitudinal central axis in one direction to move the threaded nut 226 towards the left (as viewed looking at FIG. 14). When the threaded nut 226 moves toward the left, the first and second cross members 230, 236 operate in a scissor-like manner to move the plunger member 234 downwards (as viewed looking at FIG. 14) to extend the plunger member 234 to the extended position shown in FIGS. 12 and 14. When the output shaft 251 of the second motor 250 is driven in the other direction, the threaded rod 225 rotates about its longitudinal central axis in the opposite direction to move the threaded nut 226 towards the right (as viewed looking at FIG. 14). When the threaded nut 226 moves toward the right, the first and second cross members 230, 236 operate in a scissor-like manner to move the plunger member 234 upwards (as viewed looking at FIG. 14) to retract the plunger member 234 to the retracted position shown in FIG. 13.

The pivot pin 232*d* moves horizontally (as viewed looking at FIG. 14) in the elongated slot 238 as the plunger member 234 extends and retracts. The horizontal movement of the pivot pin 232*d* within the elongated slot 238 allows the plunger member 234 to move straight up and down as the first and second cross members 230, 236 open and close like a pair of scissors. Thus, the bottom surface 235 of the plunger member 234 remains substantially parallel with the major surface 209 of the stacking platform 208 as the plunger member extends and retracts.

Figure 15:
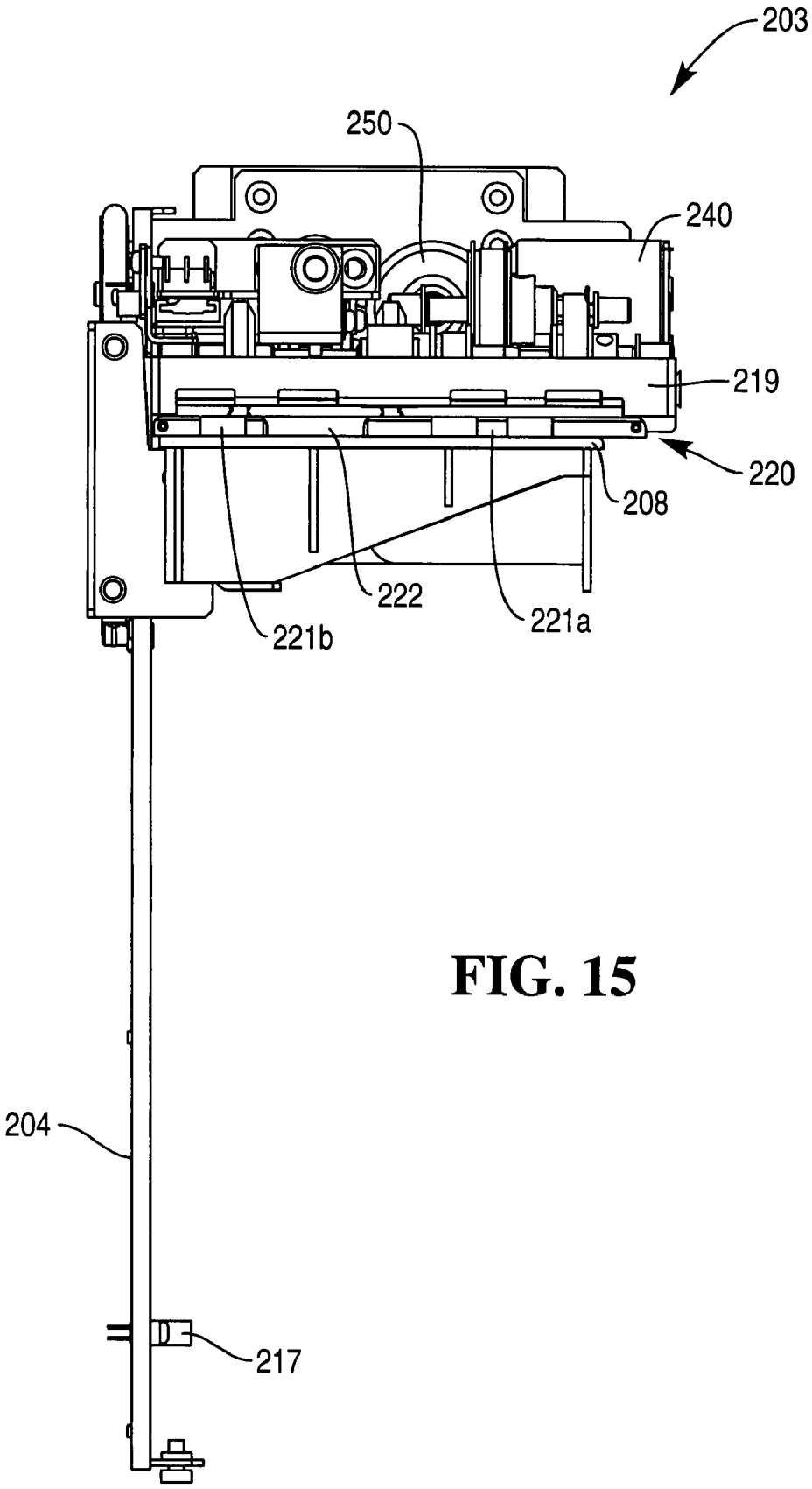
FIG. 15 is an elevational view looking in the direction of arrow B of FIG. 6.
Figure 16:
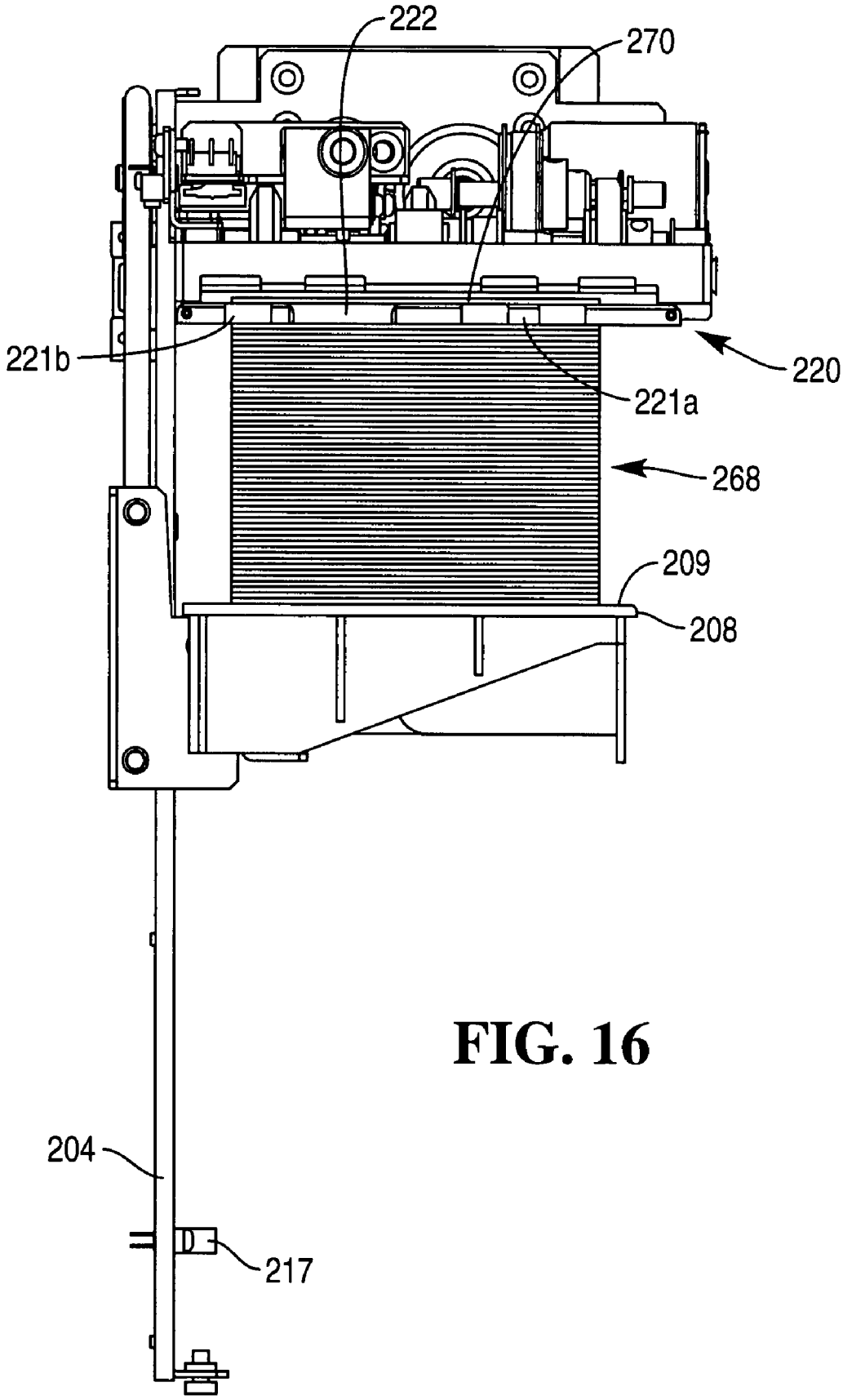
FIG. 16 is a view similar to FIG. 15, and showing parts in a retracted position and showing a check to be stacked on a stack of checks already in the document stacker bin.

Referring to FIG. 15, parts are shown in the retracted position with no stack of checks on the stacking platform 208 and no check on the receiving platform 220. Referring to FIG. 16, a stack 268 of documents is shown on the stacking platform 208 and a check 270 to be stacked is shown positioned on the plates 221*a*, 221*b* of the receiving platform 220. As previously mentioned, the sensor 248 (FIG. 11) provides a signal indicative of the check 270 being positioned on the receiving platform 220 when the sensor detects the leading edge of the check. After the sensor 248 provides this signal, the controller 86 (FIGS. 2 and 3) de-actuates the first motor 240 to halt operation of the drive rollers 246*a*, 246*b*, and actuates the second motor 250 to move the plunger member 234 from the retracted position to the extended position.

Figure 17:
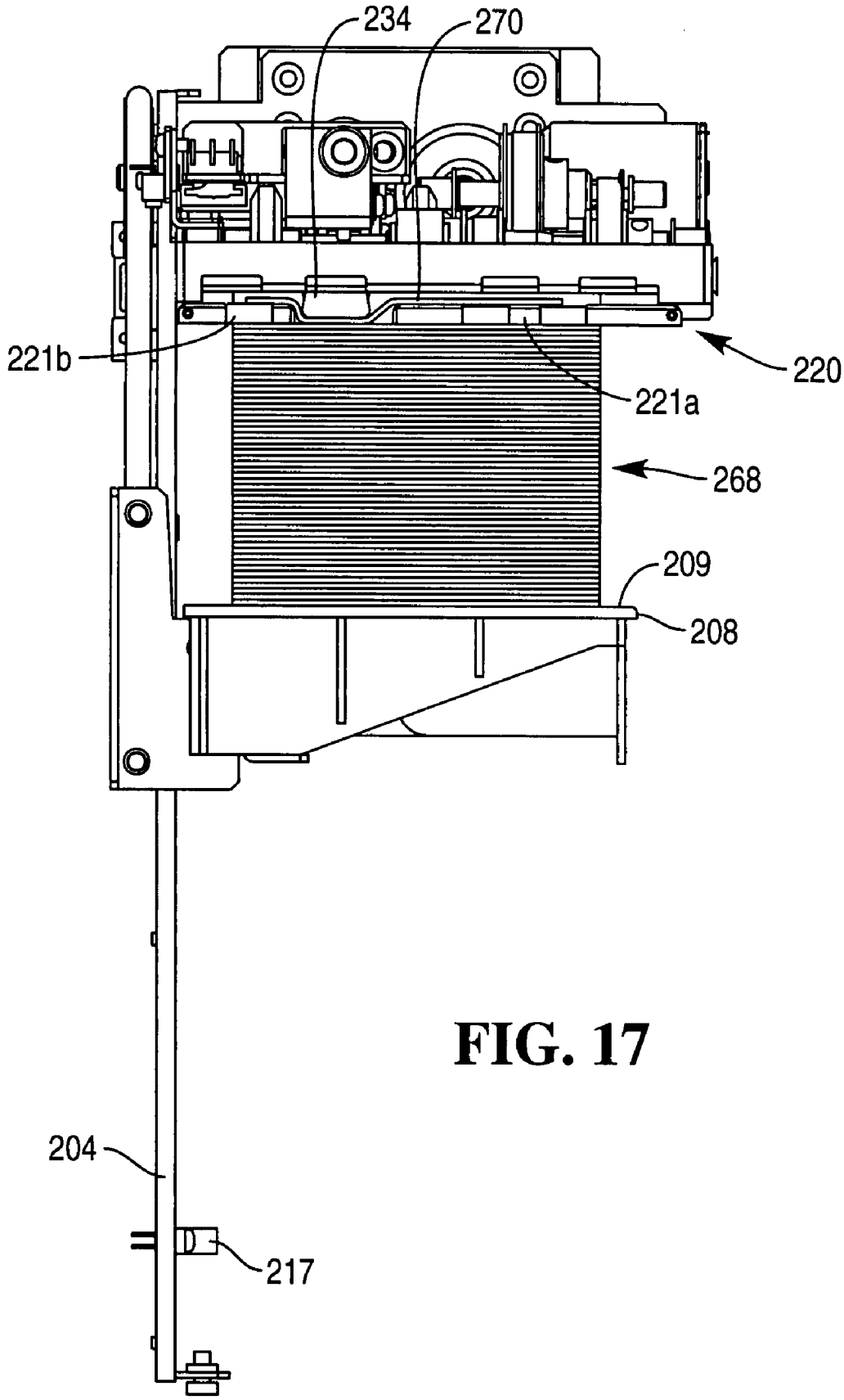
FIGS. 17-20 are views similar to FIG. 16, and showing the check to be stacked in a different position.

As the plunger member 234 (not shown in FIG. 16) moves from the retracted position shown in FIG. 16 to the extended position, it contacts the top of the check 270 and begins to push the check through the opening 222 in the receiving platform 220. As the plunger member 234 pushes the check 270 through the opening 222, the bottom of the check eventually moves into contact with the topmost check on the stack 268 as shown in FIG. 17. As the plunger member 234 continues to move to the extended position, it continues to push the check 270 onto the topmost check on the stack 268. The pushing down action of the plunger member 234 on the check 270 and the stack 268 moves the stacking platform 208 downwards resulting in the stack 268 moving downwards away from the receiving platform 220, as shown in FIG. 18.

Figure 18:
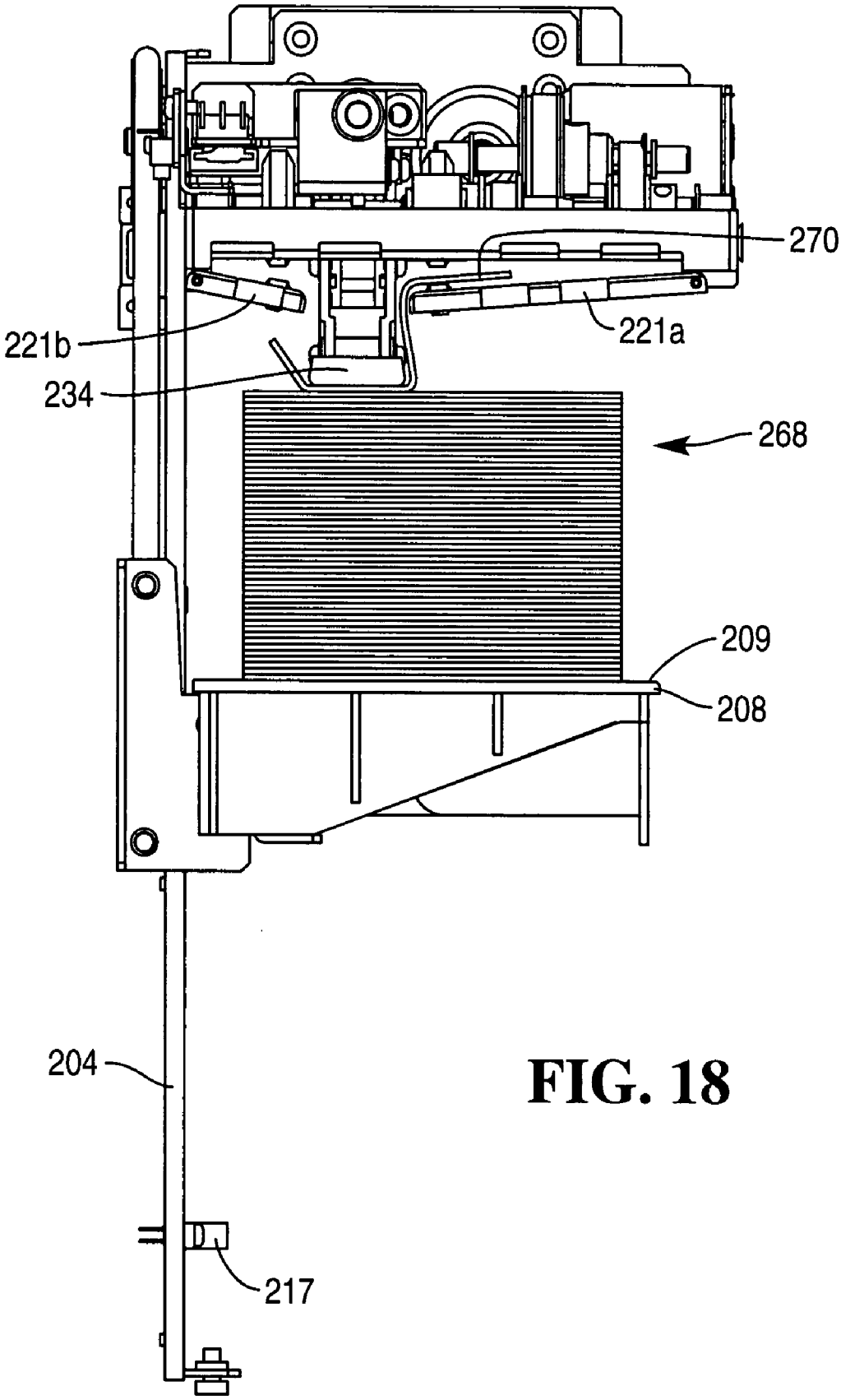

As the stack 268 moves away from the receiving platform 220, the plates 221*a*, 221*b* of the receiving platform 220 pivot from the parallel position as shown in FIG. 17 to the non-parallel position as shown in FIG. 18 due to gravity acting on the plates 221*a*, 221*b*. The substantially wide V-shape profile of the plates 221*a*, 221*b* in the non-parallel position shown in FIG. 18 provides a "cupping" effect on the check 270 to stiffen and straighten the check as the check is being pushed through the opening 222. The stiffening and straightening of the check 270 before it is stacked on the stack 268 reduces the chance of the check from crumpling and curling up when it is eventually stacked on top of the stack 268.

Figure 19:
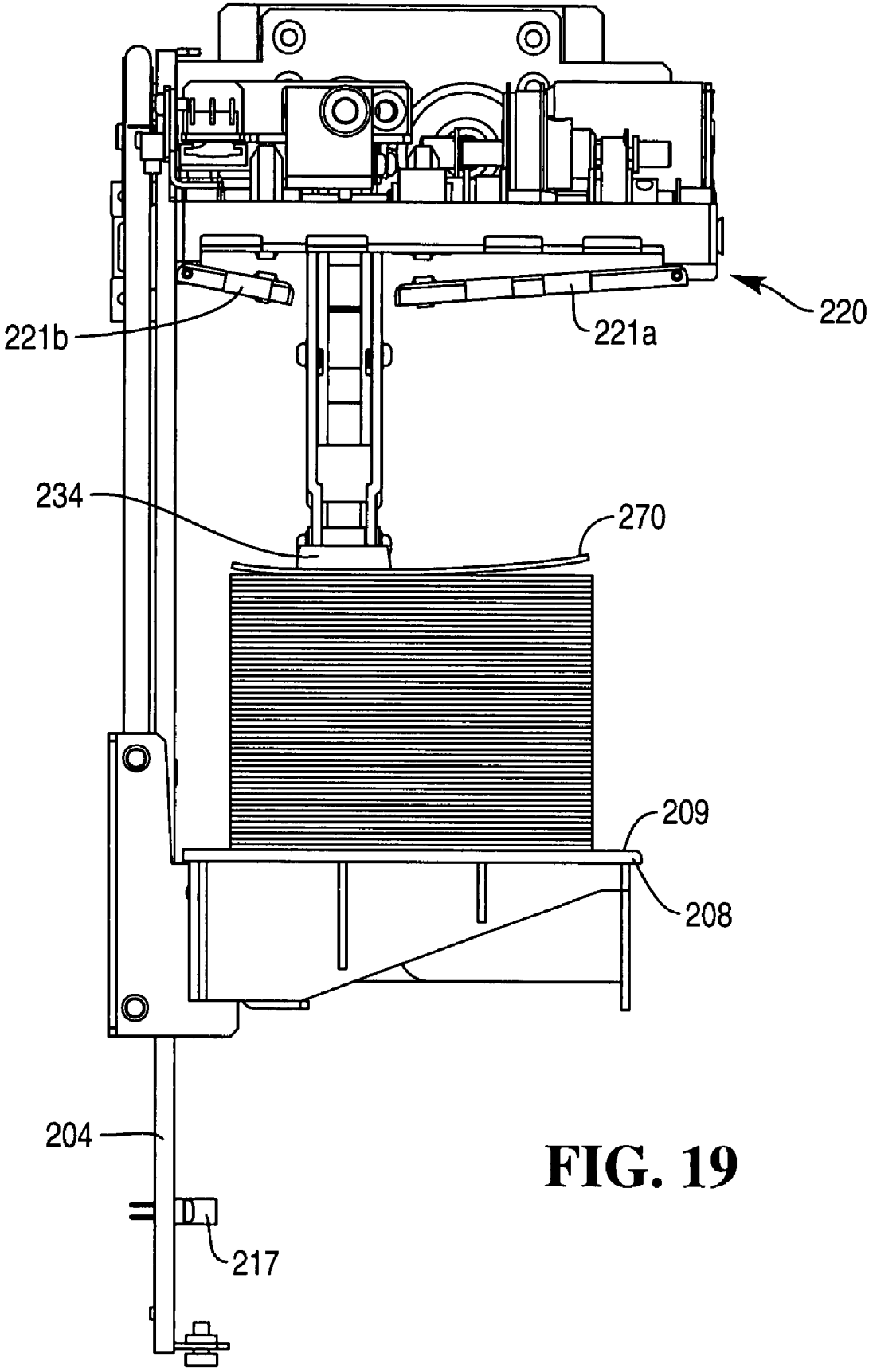
Figure 20:
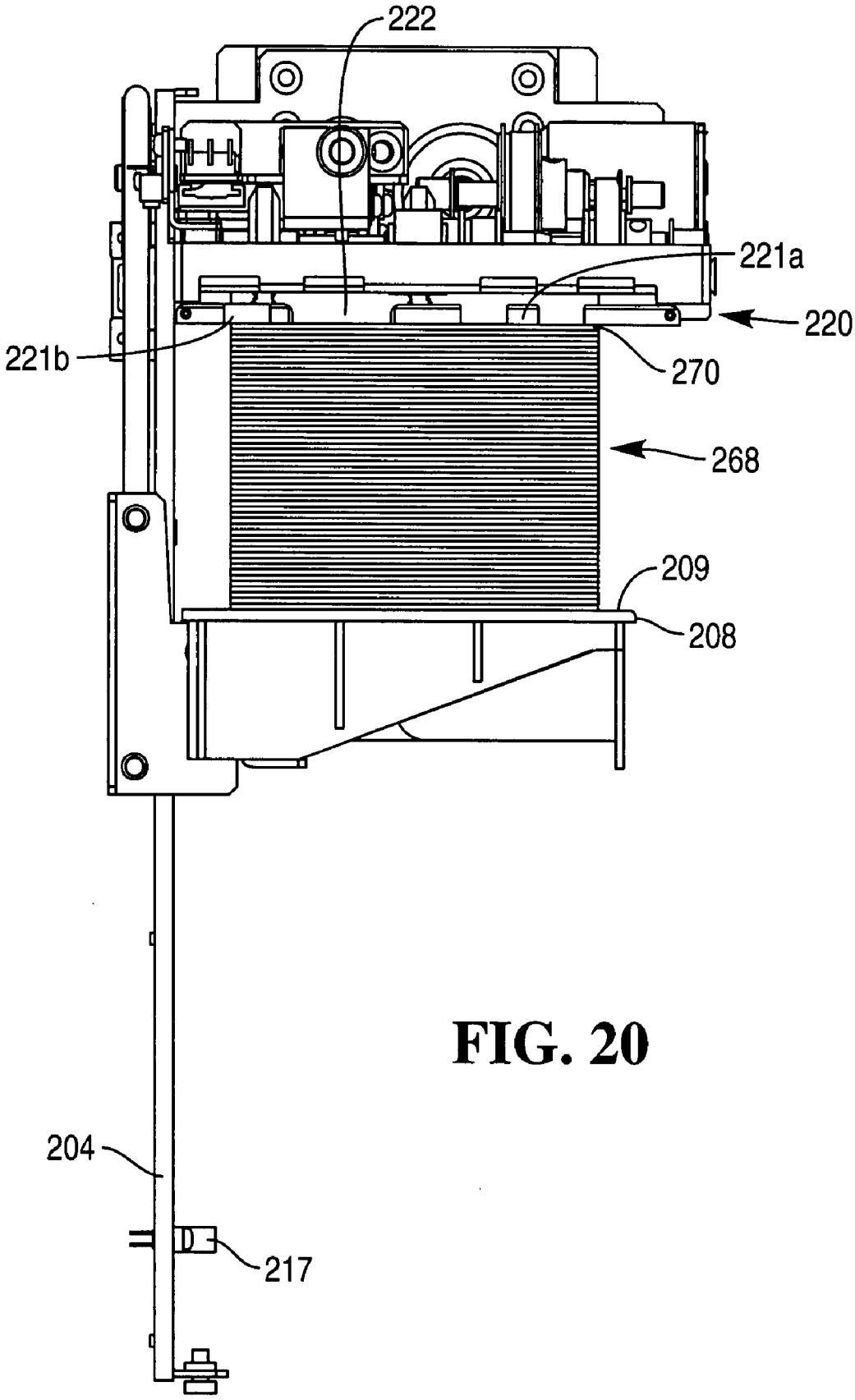

The plunger member 234 continues to push the check 270 and the stack 268 downwards from the position shown in FIG. 18 to a fully extended position shown in FIG. 19. The check 270 is positioned on top of the stack 268 when the plunger member 234 is in the fully extended position shown in FIG. 19. After moving to the fully extended position shown in FIG. 19, the second motor 250 is reversed and the plunger member 234 returns back to the retracted position as shown in FIG. 20. As the plunger member 234 returns back to the retracted position, the tension in the resilient members 214*a*, 214*b* moves the stacking platform 208 to the position shown in FIG. 20 to compress the check 270 (which now part of the stack 268) between the receiving platform 220 and the stacking platform 208. The compression of the check 270 between the receiving platform 220 and the stacking platform 208 results in the plates 221*a*, 221*b* moving back from the non-parallel position shown in FIG. 19 to the parallel position shown in FIG. 20.

Subsequent checks diverted to the stacker bin 200 will be stacked on top of the stack 268 in the same manner as described hereinabove. When the stacking platform 208 is full, the stacking platform 208 trips the sensor 217 the next time the plunger member 234 pushes a check onto the stack 268 and extends to the fully extended position. When the sensor 217 is tripped, the signal is provided to indicate that the stacker bin 200 is full.

The compression on the stack 268 between the receiving platform 220 and the stacking platform 208 should be sufficient to prevent the stack 268 from bowing out and possibly collapsing as a result of the bowing. However, it should be noted that the removable enclosure panel 202 (shown only in FIG. 5) functions as sidewall portions which laterally support the stack 268 on the stacking platform 209 and help to prevent the stack from bowing during operation of the stacker bin 200.

It should be apparent that the capacity of the stacker bin 200 is being more fully utilized since the stack 268 is compressed between the receiving platform 220 and the stacking platform 208. It should also be apparent that the chance of a deposited check being stacked out of sequence is reduced since it is difficult for the check to be stacked out of sequence when the check is pushed on top of the stack 268. Also, the tendency of a deposited check being crumpled against a previously deposited check is reduced since the check is being pushed on top of the stack 268 and not being fed in from one side of the stack. Thus, the chance of obtaining a stack of deposited checks without any stacking defect is increased.

Although the above-description describes the PERSONAS (trade mark) 5878 NCR ATM embodying the present invention, it is contemplated that other models of ATMs, other types of ATMs, or other types of self-service terminals may embody the present invention. It is also conceivable that the self-service terminal may be any type of device in a publicly accessible, unattended environment, such as a check depositing ATM, a check depositing/cashing ATM, a check cashing ATM, or the like. Self-service terminals are generally public-access devices that are designed to allow a user to conduct a transaction or to access information in an unassisted manner and/or in an unattended environment. Self-service terminals typically include some form of tamper resistance so that they are inherently resilient. Self-service terminals allow users to obtain information or to conduct a transaction. Self-service terminals include: ATMs; non-cash kiosks that allow users to access information (e.g., to view reward points on a reward card the user inserts into the self-service terminal); and kiosks that accept payment for services (e.g. Web surfing kiosks, kiosks that allow users to buy goods, etc.). The term self-service terminal has a relatively broad meaning and includes vending machines.

Also, although the above-description describes a financial document in the form of a check being deposited, it is contemplated other types of financial documents may be deposited. Moreover, it is conceivable that non-financial documents may be deposited. Documents may be of different sizes, different thicknesses, or different weights of paper. Also, although the above-description describes a check being deposited in its entire amount by an ATM customer (i.e., the user), it is contemplated that the check may be deposited only in partial amount of the entire amount of the check at the ATM 10, with the remaining amount of the check being cashed and delivered to the ATM customer.

Further, although the above-description describes using a combination of the threaded rod 225 and the threaded nut 226 to effect movement of the plunger member 234 between the retracted and extended positions, it is conceivable that other types of components may be used to effect movement of the plunger member.

It is also contemplated that the resilient members 214*a*, 214*b* described hereinabove may be in any form so long as a biasing force maintains a relatively constant pressure between the stacking platform 208 and the receiving platform 220 as the stacking platform fills up with checks. More specifically, the weight of the checks on the stacking platform 208 increases and the tension in the resilient members 214*a*, 214*b* increases as the stacking platform 208 fills up with checks. As the tension in the resilient members 214*a*, 214*b* increases, the force provided by the biasing members increases to maintain a relatively constant compression between the major surface 209 of the stacking platform 208 and the bottom side of the receiving platform 220. It is conceivable that any type of resilient members may be used to provide the necessary tension to maintain the relative constant compression between the stacking platform 208 and the receiving platform 220.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A method of operating a document stacker having a receiving platform which has a top major side surface and a bottom major side surface, a stacking plate which is disposed on one side of the receiving platform and which is biased towards the receiving platform, and a plunger which is disposed on an opposite side of the receiving platform and which is movable relative to the receiving platform, the method comprising:

receiving a document on the top major side surface of the receiving platform;

moving the plunger towards the receiving platform to push the document through an opening in the receiving platform and towards the stacking plate to stack the document on the stacking plate;

changing position of the receiving platform from a substantially flat profile to a substantially wide V-shaped profile such that the receiving platform cups the document as the document is being pushed through the opening in the receiving platform and stacked on the stacking plate; and moving the plunger away from the stacking plate and back through the opening in the receiving platform to allow the biasing force acting on the stacking plate to move the document which has just been stacked on the stacking plate into compression against the bottom major side surface of the receiving platform and thereby to reduce the chance of a stacking defect from occurring when a succeeding document is subsequently stacked on top of the document which has just been stacked on the stacking plate.

2. A method of operating an automated teller machine (ATM) comprising:

receiving a check from an ATM customer;

endorsing the check;

transporting the endorsed check to a receiving platform which has a bottom major side surface;

pushing the check through an opening in the receiving platform to stack the check on a stacking plate which faces the bottom major side surface of the receiving platform and is biased towards the bottom major side surface of the receiving platform;

changing position of the receiving platform from a substantially flat profile to a substantially wide V-shaped profile such that the receiving platform cups the document as the document is being pushed through the opening in the receiving platform and stacked on the stacking plate; and after the check has been stacked on the stacking plate, allowing the biasing force which is acting on the stacking plate to move the check which just been stacked on the stacking plate into compression against the bottom major side surface of the receiving platform to reduce the chance of a stacking defect from occurring when a succeeding check is subsequently stacked on top of the check which has just been stacked on the stacking plate.

3. A method according to claim 2, further comprising:

frictionally engaging the check as the position of the receiving platform is being changed and the check is being pushed through the opening in the receiving platform.

4. A method according to claim 2, further comprising:

reading a magnetic ink character recognition (MICR) codeline from the check before the check is endorsed.

* * * * *